US006787697B2

(12) United States Patent
Stipes et al.

(10) Patent No.: US 6,787,697 B2
(45) Date of Patent: Sep. 7, 2004

(54) CABLE CHANNEL FILLER WITH IMBEDDED SHIELD AND CABLE CONTAINING THE SAME

(75) Inventors: Jason Stipes, Columbia, MD (US); Andrew David Schaffstein, Oxford, OH (US)

(73) Assignee: Belden Wire & Cable Company, Richmond, IN (US)

( * ) Notice: Subject to any disclaimer, the term of this patent is extended or adjusted under 35 U.S.C. 154(b) by 0 days.

(21) Appl. No.: 10/204,994

(22) PCT Filed: Jan. 16, 2001

(86) PCT No.: PCT/US01/01367

§ 371 (c)(1),
(2), (4) Date: Jan. 28, 2003

(87) PCT Pub. No.: WO01/54142

PCT Pub. Date: Jul. 26, 2001

(65) Prior Publication Data

US 2004/0124000 A1 Jul. 1, 2004

Related U.S. Application Data

(60) Provisional application No. 60/177,068, filed on Jan. 19, 2000.

(51) Int. Cl.[7] ..... H01B 7/34

(52) U.S. Cl. ..... 174/36; 174/113 C

(58) Field of Search ..... 174/36, 110 R, 174/113 R, 113 C, 115, 116, 120 R; 29/624, 232; 156/47, 51–54, 160, 163, 164

(56) References Cited

U.S. PATENT DOCUMENTS

| | | | | |
|---|---|---|---|---|
| 483,285 A | | 9/1892 | Guilleaume | |
| 514,925 A | | 2/1894 | Guilleaume | |
| 1,977,209 A | | 10/1934 | Sargent | |
| 2,204,737 A | | 6/1940 | Swallow et al. | |
| 2,538,019 A | | 1/1951 | Lee | |
| 3,588,313 A | | 6/1971 | Delves-Broughton | |
| 3,603,715 A | | 9/1971 | Vinnhorst et al | |
| 3,621,118 A | | 11/1971 | Bunish et al | |
| 3,819,443 A | * | 6/1974 | Simons et al. | 156/204 |
| 3,911,200 A | | 10/1975 | Simons et al. | |
| 3,927,247 A | | 12/1975 | Timmons | |
| 4,038,489 A | | 7/1977 | Stenson et al. | |
| 4,085,284 A | * | 4/1978 | Olszewski et al. | 174/36 |
| 4,096,346 A | * | 6/1978 | Stine et al. | 174/36 |
| 4,340,771 A | * | 7/1982 | Watts | 174/36 |
| 4,374,881 A | | 2/1983 | Hamilton | |
| 4,453,031 A | * | 6/1984 | Justiss | 174/36 |
| 4,474,426 A | | 10/1984 | Yataki | |

(List continued on next page.)

FOREIGN PATENT DOCUMENTS

| | | |
|---|---|---|
| DE | 2459844 | 7/1976 |
| JP | 4-332406 A | 11/1992 |
| JP | 5-101711 | 4/1993 |
| SU | 1343447 | 10/1987 |

*Primary Examiner*—William H. Mayo, III
(74) *Attorney, Agent, or Firm*—James B. Conte; Barnes & Thornburg LLP

(57) ABSTRACT

A cable channel filler or spline and a cable containing the cable channel filler or spline in its core. The channel filler extends longitudinally and has a plurality of spaced longitudinally extending open pockets in which cables, such as unshielded twisted pair cables, are placed and form part of the core. The core containing the twisted pair cables in the pockets is jacketed. The longitudinal pockets have a cross-sectional area that is greater than the envelope diameter of the twisted pair cable to be placed in the pocket. The channel filler has an imbedded shield that extends into each of the channel filler pocket legs and is preferably prepared from a single tape. Alternatively when two tapes are used for the shield, the first tape has three shield legs and with one leg being a folded over leg and the second tape forms the fourth leg and has 20 to 50 percent—at least 1/16 in. of one of its sides encased by the folded over portion of the first tape.

3 Claims, 2 Drawing Sheets

U.S. PATENT DOCUMENTS

| | | | | | |
|---|---|---|---|---|---|
| 4,683,349 | A | | 7/1987 | Takebe | |
| 4,719,319 | A | | 1/1988 | Tighe, Jr. | |
| 4,729,409 | A | | 3/1988 | Paul | |
| 4,778,246 | A | | 10/1988 | Carroll | |
| 4,807,962 | A | | 2/1989 | Arroyo et al. | |
| 5,132,488 | A | | 7/1992 | Tessier et al. | |
| 5,177,809 | A | | 1/1993 | Zeidler | |
| 5,289,556 | A | | 2/1994 | Rawlyk et al. | |
| 5,305,797 | A | | 4/1994 | Roy, Sr. | |
| 5,444,184 | A | | 8/1995 | Hassel | |
| 5,574,250 | A | | 11/1996 | Hardie et al. | |
| 5,789,711 | A | | 8/1998 | Gaeris et al. | |
| 5,952,615 | A | * | 9/1999 | Prudhon | 174/113 C |
| 6,150,612 | A | | 11/2000 | Grandy et al. | |
| 6,222,130 | B1 | | 4/2001 | Gareis et al. | |
| 6,248,954 | B1 | * | 6/2001 | Clark et al. | 174/113 R |
| 6,288,340 | B1 | * | 9/2001 | Arnould | 174/113 R |
| 6,297,454 | B1 | | 10/2001 | Gareis | |
| 6,310,295 | B1 | * | 10/2001 | Despard | 174/113 R |
| 6,570,095 | B2 | * | 5/2003 | Clark et al. | 174/113 R |
| 6,624,359 | B2 | * | 9/2003 | Bahlmann et al. | 174/113 C |

* cited by examiner

CABLE CHANNEL FILLER WITH IMBEDDED SHIELD AND CABLE CONTAINING THE SAME

This application claims priority from provisional application No. 60/177,068 filed on Jan. 19, 2000.

FIELD OF THE INVENTION

The present invention relates to a cable channel filler or spline and to a cable having the channel filler or spline. More particularly, the present invention relates to a cable channel filler having a shield, formed from a foil tape, embedded therein and having a plurality of shield legs with the shield legs forming a plurality of channel filler/cable pockets.

BACKGROUND OF THE INVENTION

Electronic cables provide a highway through which much of today's digital information travels. Many of the cables which transmit digital information utilize a plurality of twisted pair cables. These twisted pair cables, to satisfy high-speed digital requirements, need to transmit information at high frequencies. Unfortunately, high frequencies, generally transmitted at extremely low voltages, are susceptible to electronic interference. For instance, near end crosstalk between twisted pairs within the same cable, referred to in the industry as NEXT, can interfere with high frequency sign al transmission.

To control NEXT in unshielded twisted pair (UTP) cables, the industry typically resorts to extremely short lay lengths and/or a central channel filler member that acts to physically separate the twisted pairs in order to improve crosstalk performance. The ultimate control for crosstalk is to individually shield the twisted pairs (ISTP) and electrically isolate them from one another by grounding the common shield plane. Though effective, these cables are typically quite expensive to purchase and install.

U.S. Pat. Nos. 5,789,711, 5,969,295 and 5,519,173 each describe methods used to physically separate twisted pairs with a shaped central filler in UTP or screen twisted pair cables. These configurations provide some isolation due to physical separation of the UTP's, but do not provide the benefit of a conductive isolating member between the pairs.

U.S. Pat. No. 5,952,615 describes the embodiment of an ISTP cable that utilizes a central rod filler surrounded with a shield, and an overall shield to fully isolate each twisted pair. This configuration typically requires that the shielding members be grounded and is contrary to my UTP invention. In addition, one embodiment proposes two metal tapes inside the fins of the central rod filler configures in a cruciform shape. This configuration of the two metal tapes is not desirable in that it allows the possibility of electromagnetic leakage between the joining point of the two tapes. In addition, the close proximity of the shield surrounding the entire circumference of the twisted pairs adversely affects the impedance and attenuation of the cable's twisted pairs. To maintain required impedance and attenuation values, the ISTP design requires that additional insulation material and copper volume be added to the twisted pairs, increasing the size and cost of the cable, both undesirable. Also, the proximity of the shield adversely affects the stability of electrical parameters such as impedance, attenuation and return loss.

U.S. Pat. No. 3,819,443 describes a shielding member comprised of laminated strips of metal and plastic materials that are cut, bent and assembled to define radial branches of a shielding member. This configuration also has many of the same problems previously described. The assembly of the tapes allows a channel for electromagnetic leakage to be transmitted from opposite pairs.

SUMMARY OF THE INVENTION

Our cable improves the isolation of a plurality of twisted pairs from each other by having a channel filler with a plurality of longitudinally extending tubular pockets and an internal metal shield. In some instances, it is preferred that the channel filler cable pockets have a cross-sectional area that is equal to or greater than the diameter of the envelope area of the wire(s) or cable(s) that are to be placed in each of the pockets. The metal shield is embedded in the channel filler to isolate each of the channel filler pockets. The channel filler shield is preferably a single tape that is folded to the conformity of the shape of the channel filler and extends into and is embedded by each of the pocket legs. The single shield tape is folded to provide a plurality of fins or legs so that there is a shield leg for each of the channel filler pocket legs. We also provide an improved two tape shield. In the two tape shield a first shield tape is folded to provide the plurality of shield legs and the second shield tape provides one shield leg. The second shield leg has 20–50%—at least 1/16 inch of one side thereof being encased by a folded over portion of one of the first shield tape legs.

A communication cable manufactured using the channel filler of our invention generally has an unshielded twisted pair cable in each pocket. Then the twisted pair containing channel filler is jacketed.

The present invention and the advantages thereof will become more apparent upon consideration of the following detailed description when taken in conjunction with the accompanying drawings

DETAILED DESCRIPTION OF THE INVENTION

The following description taken in conjunction with the drawings will further explain the inventive features of our elongated channel filler and cables utilizing our elongated channel filler.

Figure 1:
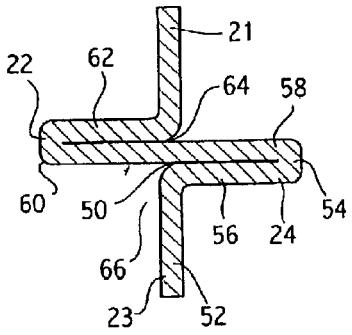
FIGS. 1–3 are enlarged cross-sectional views of the single tape shields each having four shield legs.
Figure 9:
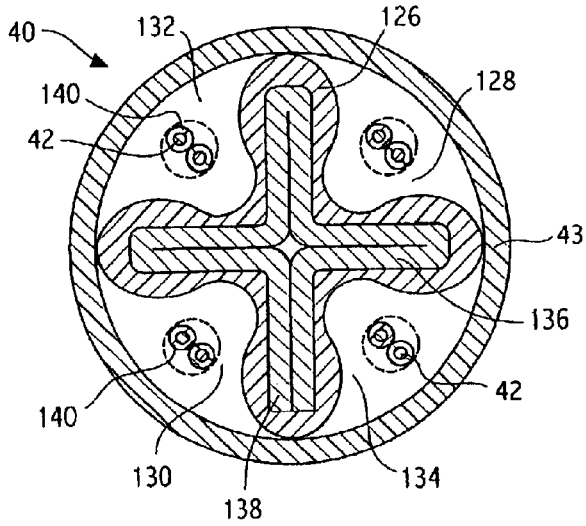
FIG. 9 is an enlarged cross-sectional view of a cable having the channel filler of FIG. 6.

Referring to FIG. 1, our elongated channel filler shield 20 has along its cross-sectional plane a first leg 21, a second leg 22, a third leg 23, and a fourth leg 24. The shield is made from a single tape having a width equal to about six times the width of each leg when all of the legs 21–24 have equal widths. The shield legs 22 and 24 are folded legs to provide a thickness double the thickness of shield legs 21 and 23. The shield in FIG. 1 is formed by folding the tape 90 degrees at a first point 50 to form a first segment 52, which is the first leg 23 of the shield. The first segment 52 is approximately 1/6 of the total width of the tape. The tape is then folded 180 degrees at a second point 54 to form a second segment 56 and a third segment 58, which forms the second 24 leg of the shield. The second segment is approximately ⅙ and the third segment is approximately ⅔ of the total width of the tape. The tape is then folded 180 degrees at a third point 60 to create a fourth segment 62, completing the third leg 22 of the shield. Lastly, the tape is folded 90 degrees at a fourth point 64, creating the fourth leg 21 of the shield. The second, third and fourth segments 56, 58 and 62 are compressed, eliminating gaps therebetween. The space between each leg creates pockets 66 adapted to accept the placement of twisted pair cables 42 as shown in FIG. 9. Each pocket 66 has a 90 degree inner edge and are defined by two legs of the shield and by a cable jacket 43. Since there are no breaks in the one piece shield, frequency interference from each pocket is significantly reduced over previous shield designs.

Figure 2:
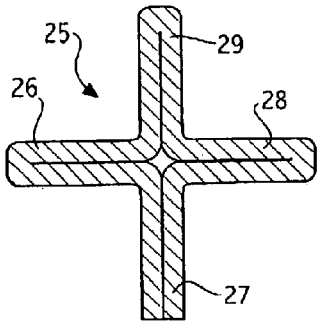
Figure 10:
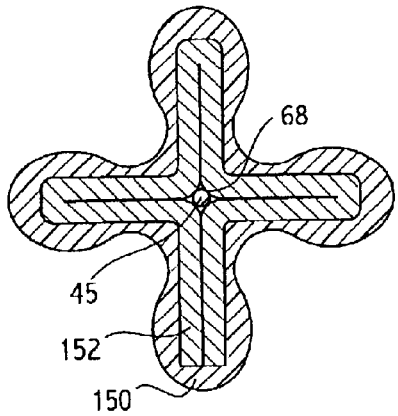
FIGS. 10 and 11 are cross-sectional views of our elongated channel filler having a drain wire or strength member.

Referring to FIG. 2, our shield 25, all four legs 26,27, 28 and 29 have a double layer of shield tape. The double layers are engaging each other when the shield tape is imbedded in a channel filler. By folding a single piece of shield tape into this configuration, it is possible to place a drain wire or strengthening member at the converging point of the four legs 26,27, 28 and 29. The a drain wire or strengthening member 45 and the converging point 68 are shown in FIG. 10. With this configuration, each leg 26,27, 28 and 29 has a length approximately ⅛ of the total width of the tape. The benefit of the shield 25 is that each leg 26,27, 28 and 29 is comprised of two segments of tape, allowing the use of thinner tape.

Figure 3:
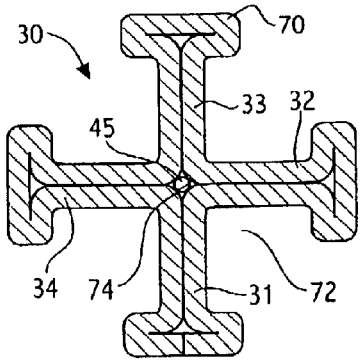
Figure 11:
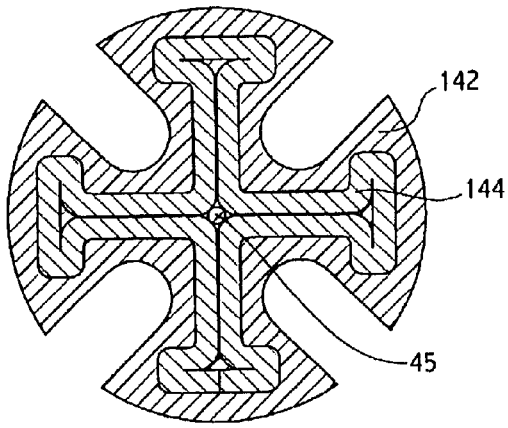

FIG. 3 another of our shields 30 made from a single tape folded to provide for double layer "T" shield legs 31, 32, 33 and 34. The legs, 31, 32, 33 and 34, and the top 70 of the "T", are double layered and shaped to coincide with the shape of the side ends of the channel filler legs, as shown in FIG. 11. This design further reduces interference by partially closing off the pockets 72 that contain the twisted pair cables. By folding a single piece of shield tape into this configuration, it is possible to place a drain wire or strengthening member 45 at the converging point 74 of the four legs 31, 32, 33 and 34.

Figure 4:
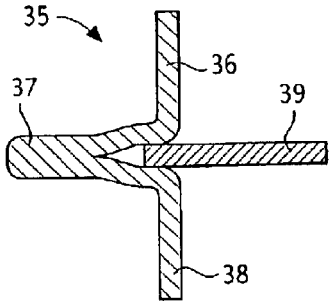
FIG. 4 is an enlarged cross-sectional view of a two tape shield constructed according to our invention.

Referring to FIG. 4, there is shown another of our channel filler shield 35 made of two shield tapes and having shield legs 36, 37, 38 and 39. Legs 36, 37 and 38 are made with a single shield tape with leg 37 being folded over to provide a double layered leg. Leg 39 is formed by the second tape and has 20–50%—at least 1/16 inch of one side encased between the folded over portions of shield leg 37. The at least 1/16 in. encased portion is needed prevent the leg 39 from disengaging from between the folded portions of the leg 37. When assembled, leg 39 is placed between the segments of the leg 37. By utilizing a two tape shield of this design, electromagnetic leakage between the joining point of the two tapes is eliminated because of the overlap between the tapes.

Referring to FIGS. 5–8, there are shown different shapes of channel fillers having embedded therein any one of the shields of FIGS. 1, 2, and 4. Since the foil tape is flexible, it is possible to bend the legs into a position that conforms with the shape of the channel fillers. By using the shields of FIGS. 1, 2 and 4, it is possible to form the shield from the tape and apply the filler in a continuous operation, eliminating steps need for other cable designs.

Figure 5:
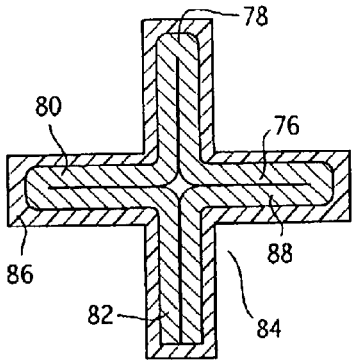
FIGS. 5–8 are enlarged partial cross-sectional plan view of various channel fillers with our imbedded shield.
Figure 6:
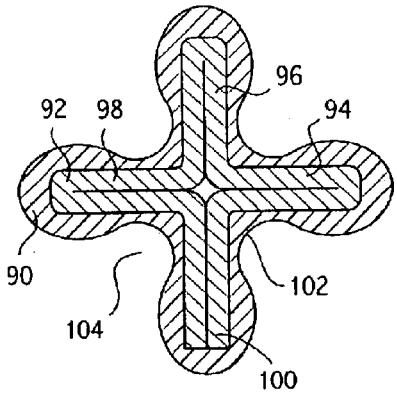
Figure 7:
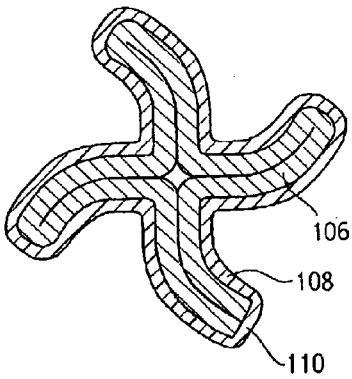
Figure 8:
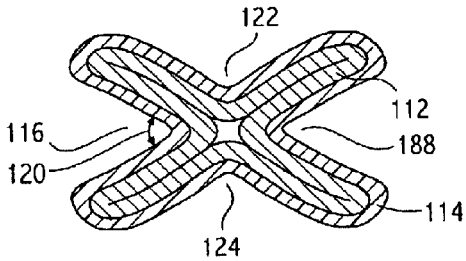

The preferred material for the elongated channel filler is any suitable polymer or copolymer depending on the needs of the user for crush resistance, breaking strength, gel fillings, safety, and the need for flame and smoke resistance. In many applications the material will be a flame retardant polyethylene or polyvinyl chloride. Since the filler is a polymer material, it is possible to apply the filler in various shapes to accommodate cable design requirements. The filler is designed to follow the contours of the shield and to further insulate the pockets and add overall strength to the finished cable. The cross section of the filler 86 with the embedded shield 88, shown in FIG. 5, illustrates a plus-symbol shaped filler that has four legs 76, 78, 80 and 82 that define the pockets 84. The cross section of the filler 90 with the embedded shield 92 in FIG. 6 illustrates the shield 92 with the legs 94,96,98 and 100 in a perpendicular orientation. The filler 90 surrounds the shield 92. The tips of the legs 94, 96, 98 and 100 are rounded, which conforms to the shape of the cable. The inner edges 102 are also rounded to create a curved pocket 104. FIG. 7 illustrates a shield 106 and a filler 108 with curved tips 110 that conform with certain cable design requirements. Since the shield 106 is flexible, it is possible to form it into the desired shape. FIG. 8 illustrates a shield 112 and a filler 114 that is formed so that pockets 116 and 118 have an interior angle 120 smaller than pockets 122 and 124. This filler design is used in cables having an oval or rectangular cross-section.

Referring to FIG. 9, there is shown a cable 40, having as its core our elongated channel filler 126 with first pair of diametrically opposed pockets 128 and 130 each containing an unshielded twisted pair cable 42, and second pair of pockets 132 and 134 each also containing an unshielded twisted pair cable 42. The core 136 which contains our elongated channel filler 126 has an embedded shield 138, and the cables 42, in its pockets. The core is surrounded by a jacket 43 which was extruded thereover. The jacket 43 can be any suitable jacket material normally utilized such as foamed on non-foamed polyvinyl chloride, fluorinated polymers, polyethylene, the flame retardant compositions, etc.

Each unshielded twisted pair cable 42 has a pair of conductors with appropriate insulation 140. The conductors are generally copper, tinned copper, or any other appropriate conductor. The conductor insulation 140 is a foamed or non-foamed insulation of polyethylene, polypropylene, fluorinated ethylene propylene, tetrafluoroethylene, polyvinyl chloride, etc.

Referring to FIG. 10, there is shown a channel filler 150 having an embedded shield 152 and a drain wire 45 located in opening 68. The channel filler has the same shield construction as the shield of FIG. 2. In this embodiment, the drain wire 45 is between double layers of the channel filler shield 152.

Generally for a communication cable having four twisted pair cables, all of the same size with or without different lays, uses our shield channel filler. The channel filler has a diameter of about 0.150 inches to about 0.350 inches. The size of the twisted pair cables 42 are generally about 24 AWG to about 22 AWG. For other applications, the channel filler will have as many pockets or pocket legs as needed. For instance, in a four pair cable, the channel filler will have four pocket legs, in a 10 pair cable, the channel filler would have 10 pocket legs. Likewise, the embedded shield would have 4 and 10 shield legs respectively.

The shields may be any suitable shield such as an aluminum or copper tape, BELDFOIL, DUOFOIL, or any suitable metal tape. The shield which uses a polymer base can have aluminum or copper on one of both sides of the polymer base. The thickness of the metal on the shield is about 0.0003 to 0.001 inches.

Referring to FIG. 11, there is shown a channel filler 142 having an embedded shield 144 and a drain wire or strengthening member 45. The channel filler has the same shield construction as the shield of FIG. 3. In this embodiment, the drain wire is between the double layers of the channel filler shield.

The drain wire, is generally made with finned copper, tinned aluminum, etc. the strength member is generally made from polyethylene.

It will, of course, be appreciated that the embodiments which have just been described have been given by way of illustration, and the invention is not limited to the precise embodiments described herein. Various changes and modifications may be effected by one skilled in the art at without departing from the scope or spirit of the invention as defined in the appended claims.

We claim:

1. A metal shield for data transmission cables comprising:

a plurality of longitudinally extending spaced shield legs, said shield legs formed from a first and a second metal shield tape, said first shield tape being a continuous single piece metal shield tape folded to provide at least three longitudinally extending shield legs; and said second shield tape forms at least one of said shield legs, said second tape has about 20 percent to about 50 percent or at least 1/16 inch of one side thereof encased by a folded over portion of one of said first shield tape legs.

2. The metal shield of claim 1, wherein said first and second metal shield tapes have a thickness of about 0.0003 inches to about 0.001 inches, and said metal shield tapes are selected from aluminum, copper, and a polymer base having aluminum or copper on one or both sides of the polymer base.

3. A signal transmission cable comprising:

an interior channel filler body extending along a longitudinal length of said cable having at least three longitudinally extending spaced open pockets formed by at least three longitudinally extending filler legs; each of said pockets has therein a twisted pair insulated conductor; a metal shield, said shield is formed from a first and a second metal shield tape;

said first shield tape being a continuous single piece metal shield tape folded to provide at least three longitudinally extending shield legs; said second shield tape forms at least one of said shield legs, said second tape has about 20 percent to about 50 percent or at least 1/16 inch of one side thereof encased by a folded over portion of one of said first shield tape legs.

* * * * *